United States Patent [19]

Rosenberg

[11] 4,007,098

[45] Feb. 8, 1977

[54] BATHS AND ADDITIVES FOR THE ELECTRODEPOSITION OF BRIGHT ZINC

[75] Inventor: William E. Rosenberg, Strongsville, Ohio

[73] Assignee: Columbia Chemical Corporation, Cleveland, Ohio

[22] Filed: Sept. 4, 1975

[21] Appl. No.: 610,251

[52] U.S. Cl. ..... 204/55 R; 204/DIG. 2

[51] Int. Cl.[2] ..... C25D 3/22

[58] Field of Search ..... 204/55 R, 55 Y, 43 Z, 204/44, DIG. 2; 260/2 A, 2 BP

[56] References Cited

UNITED STATES PATENTS

| | | | |
|---|---|---|---|
| 2,383,798 | 8/1945 | Hull | 204/50 Y |
| 2,451,426 | 10/1948 | Bair et al. | 204/55 Y |
| 2,791,554 | 5/1957 | Winters | 204/55 R |
| 3,251,852 | 5/1966 | DeGroote et al. | 260/309.6 |
| 3,577,313 | 5/1971 | Bolger et al. | 162/164 |
| 3,838,026 | 9/1974 | Koch | 204/55 R |
| 3,869,358 | 3/1975 | Nobel et al. | 204/55 Y |
| 3,871,974 | 3/1975 | Duchene et al. | 204/55 R |
| 3,884,774 | 5/1975 | Kessler | 204/55 Y |
| 3,886,054 | 5/1975 | Suchene et al. | 204/55 R |

*Primary Examiner*—G. L. Kaplan
*Attorney, Agent, or Firm*—Oldham & Oldham Co.

[57] ABSTRACT

It has been found that a linear aliphatic amine polymer obtained from the reaction of a linear aliphatic polyamine and an epihalohydrin results in an acid zinc electroplating bath brightener.

Additionally, when dissolved in an aqueous, acid zinc electroplating bath, the linear aliphatic amine polymer reaction product acts synergistically with polyoxyethylene condensates and aromatic aldehydes and ketones to provide extremely bright electrodeposits of zinc.

43 Claims, No Drawings

BATHS AND ADDITIVES FOR THE ELECTRODEPOSITION OF BRIGHT ZINC

BACKGROUND OF THE INVENTION

The present invention relates to improvements in the electrodeposition of zinc from aqueous, acid plating baths. The use of polyamines as brightening agents in acid zinc plating baths is not new to the electroplating industry. U.S. Pat. No. 3,723,263 specifically discloses the combination of polyethylene imine and certain polyoxyethylene condensates. In a pending application filed with the U.S. Patent Office by the inventor herein, the use of aminated polyepichlorohydrin is disclosed as an acid zinc electroplating brightener along with polyoxyethylene condensates and aromatic aldehydes and ketones.

The bath formulations using polyethylene imine have a limiting factor in that at bath temperatures about 95° F a severe loss of brightness of the electrodeposit occurs. Although the use of aminated polyepichlorohydrin has significantly minimized this high temperature deficiency, there exists another problem that is common to baths containing either the polyethylene imine or the aminated polyepichlorohydrin. When used with polyoxyethylene compounds and aromatic aldehydes and aromatic ketones, these polyamines produce quite dark electrodeposits upon extended electrolysis in the extreme low current-density areas of the parts of articles being plated. This situation can be corrected only by adding large amounts of expensive aldehydes and ketones. But even then, the problem is only temporarily overcome.

Since electroplaters often plate irregularly shaped articles with very low current-density areas, a bath that will consistently provide bright plate in these areas is extremely desirable.

SUMMARY OF THE INVENTION

Accordingly, it is an object of this invention to provide brightening agents which consistently produce bright electrodeposits of zinc after extended electrolysis, especially at low current-densities.

It is a further object of this invention to provide brightening agents which produce extremely bright electrodeposits of zinc over a very wide current-density range and at relatively high bath temperatures.

It is another object of the invention to produce an extremely bright electrodeposit of zinc, through the utilization of a linear aliphatic amine polymer resulting from the reaction of a linear aliphatic polyamine and an epihalohydrin.

It is yet another object of the present invention to produce an extremely bright electrodeposit of zinc through the synergistic combination of a linear aliphatic amine polymer, an ethylene oxide condensation product, and an aromatic aldehyde or aromatic ketone.

These and other objects of the present invention, together with the advantages thereof over existing prior art formulations which will become apparent from the following specification, are accomplished by the compounds, formulations, and methods herein described and claimed.

In general, a zinc brightener additive for an aqueous, acid zinc electroplating bath comprises a linear aliphatic amine polymer, said polymeric amine prepared by reacting about 50 percent to about 150 percent of a stoichiometric amount of an epihalohydrin selected from the group consisting of epichlorohydrin and epibromohydrin with a linear aliphatic polyamine selected from the group consisting of a compound having at least two primary amine groups, two secondary amine groups, or one primary and one secondary amine group, separated by 2 through 6 methylene groups or alkyl substituted methylene groups. A stoichiometric amount is defined here as an equilmolar amount.

This invention also relates to an aqueous, acid zinc electroplating bath for producing a bright electrodeposit of zinc, comprising, zinc ions, and having dissolved therein about 0.5 to about 10 grams/liter of a linear aliphatic amine polymer prepared by reacting about 50 percent to about 150 percent of a stoichiometric amount of an epichlorohydrin selected from the group consisting of epichlorohydrin and epibromohydrin with a linear aliphatic polyamine selected from the group consisting of a compound having at least 2 primary amine groups two secondary amine groups, or one primary and one secondary amine group, said amine groups separated by 2 through 6 methylene groups or alkyl substituted methylene groups.

Additionally, the invention relates to an aqueous, acid zinc electroplating bath, as set forth in the immediately preceding paragraph, said bath further containing from about 1 to about 10 grams/liter of an ethylene oxide condensation product, and from about 0.05 to about 0.5 grams/liter of at least one compound selected from the group consisting of aromatic aldehydes and aromatic ketones.

DESCRIPTION OF THE PREFERRED EMBODIMENTS

According to the concepts of the present invention, it has been found that certain linear aliphatic amine polymers are very effective zinc brighteners in aqueous, acid zinc electroplating baths. Additionally, it has been found that when the linear aliphatic amine polymers are added to an aqueous, acid zinc electroplating bath along with an ethylene oxide condensation product and an aromatic aldehyde or aromatic ketone, extremely bright electrodeposits of zinc are produced over a very broad plating range, especially at low current densities, and at relatively high bath temperatures. The effect is truly synergistic in that the results obtained with this combination far exceed the results obtained by using these compounds alone or in any combination of only two.

It has been also found that upon extended electrolysis, dark electrodeposits are not obtained in low current-density areas as they are when polyethylene imine and aminated polyepichlorohydrin are used.

Both the polyethylene imine and aminated polyepichlorohydrins possess a considerable amount of branching. In both cases the branched groups are pendent amines. Polyethylene imine is generally considered to contain approximately 50 percent secondary amine, 25 percent tertiary amine, and 25 percent primary amine. This distribution of amines would give the following repeating molecular structure:

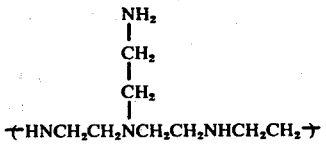

Aminated polyepichlorohydrins are polyethers wherein all of the amine groups on a molecule are at the ends of pendent groups or branches as shown in the following repeating structure:

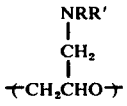

wherein the group — NRR′ is an aliphatic or alicyclic amino group.

The most characteristic difference between the linear aliphatic amine polymers of this invention and the polyamines described above is that there is a significant absence of pendent amine groups attached to pendant groups or branches of the backbone of the linear aliphatic amine polymers. Rather, the amine groups are generally present as secondary amines and are actually part of the backbone of the polymer. Shown below for example, is the probable structure of the reaction product of ethylene diamine and epichlorohydrin:

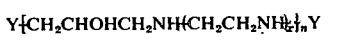

where Y is hydrogen, hydroxy, chloro, or $(CH_2CH_2NH)_x$H, $x$ is 1, and $n$ is about 5 to 200.

According to the present invention, it has been found that superior results are obtained for unknown reasons with polymers possessing no pendent amine groups as compared to highly branched polymeric amines. Such a result is both very surprising and novel.

The linear aliphatic polymeric amines of this invention are prepared by the reaction of about 50 percent to about 150 percent of a stoichiometric amount of an epihalohydrin selected from the group consisting of epichlorohydrin and epibromohydrin, and a linear aliphatic polyamine selected from the class consisting of a compound containing at least two primary amine groups, two secondary amine groups, or one primary and one secondary amine group, the amine groups separated by two through six, preferably two or three, methylene groups or alkyl substituted methylene groups.

While the choice of a linear aliphatic polyamine is quite large, specific preferred examples include the compounds set forth in Table I.

TABLE I 1. ethylene diamine
2. propylene diamine
3. diethylene triamine
4. triethylene tetramine
5. tetraethylene pentamine
6. pentaethylene hexamine
7. N-(2-aminoethyl)1,3-propanediamine The reaction to form the linear aliphatic amine polymer of the present invention is carried out in a suitable vessel equipped with a reflux condenser. In general, the temperature of the addition of the epihalohydrin and the reflux step is from about 110° F to about 220° F with the addition temperature being at the lower end of this range and the reflux step being at the higher end of this range. The invention will be better understood by reference to the following examples.

EXAMPLE I

Add 206 grams of diethylene triamine to a reaction flask. Next, add 910 ml. of water. With mixing slowly add 185 grams of epichlorohydrin, adding at such a rate that the exothermic reaction desirably does not raise the solution temperature over 130° F. Some cooling may be necessary. After all the epichlorohydrin has been added, the solution is heated to reflux at 215° F and held at that temperature for 2 hours. The solution is then allowed to cool and is used as an additive or portion of an additive without necessity for further dilution.

EXAMPLE II

Add 378 grams of tetraethylene pentamine to a reaction flask. Next, add 1320 ml. of water. With mixing slowly add 185 grams of epichlorohydrin, adding at such a rate that the reaction does not raise the solution temperature over 160° F. After all the epichlorohydrin is added, the solution is heated and refluxed for 2 hours at a temperature of about 215° F. Upon cooling, the solution is used without necessity for further dilution as an additive for bright zinc plating.

EXAMPLE III

Add 292 grams of triethylene tetramine to a reaction flask. Next, add 1500 ml. of water. With mixing slowly add 274 grams of epibromohydrin, adding at such a rate that the temperature of the solution does not rise above 160° F. When all the epibromohydrin is added, heat the solution and reflux for 3 hours at a temperature of 215° F. Upon cooling, the solution is used on an as is basis as a zinc plating additive.

Amounts of epihalohydrin higher than about 1.25 of an equal molar amount of amine may be used, but a certain amount of cross-linking will occur and the reaction product may have only limited solubility in an aqueous, acid zinc electroplating bath. Since the cross-linking involves branching of epihalohydrin groups and pendent amines are not formed, no low current density darkening upon extended electrolysis is observed. Amounts of epihalohydrin lower than about 0.75 of an equal molar amount of amine may be used, but this creates comparatively short chain polymers as a result. Polymers of rather short chain lengths require higher concentrations in the plating bath than longer chain polymers to produce the same degree of beneficial effect. In no case will the unreacted amine produce satisfactory results in place of the epihalohydrinpolyamine reaction product of this invention. Since the chain lengths are very short, extremely high concentrations are required in the plating bath to provide brightness over a wide current-density range. When these amines are used in such high concentrations, they produce even more severely dark electrodeposits in the low current-density areas than are obtained when using the polyethylene imine and aminated polyepichlorohydrin. Thus, a preferred molar ratio of epihalohydrin to polyamine is from about 0.75 to about 1.25.

The linear aliphatic amine polymers of this invention are used at a concentration of about 0.5 to about 10 grams/liter of plating bath and the preferred amount is about 2 grams/liter. They are generally added as aqueous solutions for convenience in handling. Additionally, solvents such as methanol, ethanol, and isopropanol may be utilized.

The ethylene oxide condensation products of this invention are readily available in commerce. They are used at a concentration of about 1 to about 10 grams/-liter of bath and the preferred amount is about 5 grams/liter. In combination with the linear aliphatic amine polymers as an additive, the weight percent of the ethylene oxide condensate may range from about 1 to about 99 and hence the weight percent of the linear aliphatic amine polymers will range from about 1 percent to about 99 percent. They are prepared by condensing at least six moles and up to about 30 moles of ethylene oxide per mole of long chain fatty alcohol, long chain fatty acid, long chain fatty amine, long chain alkyl phenol, or naphthol. Long chain is defined here as an aliphatic chain of at least 6 carbon atoms and up to about 30 carbon atoms. Preferably from 6 carbon atoms to 20 carbon atoms are utilized. Of the two naphthols that are possible, the beta naphthol is the preferred choice. Of course, many long chain groups exist such as lauryl, stearyl, nonyl and the like. Additional groups or compounds are well within the knowledge of one skilled in the art.

The choice of aromatic aldehydes and aromatic ketones is quite broad. Table II lists some specific preferred aldehydes and ketones of this invention. Concentrations of from about 0.05 to about 0.5 grams/liter of plating bath solution may be used with the preferred amount being about 0.1 grams/liter. Benzylidene acetone has been found to give the best results and is therefore the highly preferred.

Table II

1. Benzylidene acetone
2. Vanillan
3. Heliotropin
4. Anisaldehyde
5. Veratraldehyde
6. Acetophenone
7. Acetonaphthone
8. Cinnamic aldehyde
9. 2-chlorobenzaldehyde
10. 2,6-dichlorobenzaldehyde The aldehydes and ketones can be added in concentrated form, but are more conveniently added in a suitable solvent such as methanol or ethanol. When utilized in combination with the linear aliphatic amine polymers of the present invention as an additive, the weight percent of the aldehyde or ketone may range from about 1 to about 20 percent.

Generally, the source of zinc ions may be from any zinc salt such as zinc sulfate, zinc acetate, etc., with zinc chloride being preferred. A suitable concentration of zinc ions is from about 7.5 to about 40 grams/liter. Additionally, a pH range of about 4.0 to about 6.5 is desired for good plating results. Of course, the use of ammonium chloride is highly preferred and a desirable range is from 100 to 300 grams/liter.

While the addition agents of this invention are effective in many aqueous, acid zinc plating bath formulations, the use of any of the basic baths described in the following examples have been found to give desirable results. Of course, it will be understood that the following examples are merely illustrations and that the invention is not limited thereto.

EXAMPLE IV

| BATH COMPOSITION | CONCENTRATION IN GRAMS/LITER |
|---|---|
| Zinc Chloride | 30 |
| Ammonium Chloride | 200 |
| pH=5.0 | |
| Linear Aliphatic Amine Polymer Derived From Epichlorohydrin and Diethylene Triamine | 2 |
| Beta Naphthol Condensed With 12 Moles of Ethylene Oxide | 5 |
| Benzylidene Acetone | 0.1 |

EXAMPLE V

| BATH COMPOSITION | CONCENTRATION IN GRAMS/LITER |
|---|---|
| Zinc Sulfate | 40 |
| Ammonium Chloride | 180 |
| pH=6.0 | |
| Linear Aliphatic amine Polymer Derived From Epichlorohydrin and Triethylene Tetramine | 1.5 |
| Nonyl Phenol Condensed with 14 Moles of Ethylene Oxide | 5 |
| Benzylidene Acetone | 0.2 |

EXAMPLE VI

| BATH COMPOSITION | CONCENTRATION IN GRAMS/LITER |
|---|---|
| Zinc Chloride | 30 |
| Ammonium Chloride | 180 |
| pH=5.5 | |
| Linear Aliphatic Amine Polymer Derived From Epichlorohydrin And Tetraethylene Pentamine | 2.5 |
| Nonyl Alcohol Condensed with 10 Moles of Ethylene Oxide | 6 |
| Benzylidene Acetone | 0.1 |

All testing was done in a conventional 267 ml. Hull cell using steel cathode panels and a zinc anode. Three ampere panels were run for five minutes at temperatures ranging from 70° F to 105° F with mechanical agitation. The test results from baths of Examples IV, V, and VI, along with comparative bath compositions are given in Tables III, IV, and V.

TABLE III*

| BATH COMPOSITION | PLATING TEST RESULTS |
|---|---|
| Bath of Example IV | Extremely bright from about zero to well over 175 amps./sq. ft. |
| Bath of Example V | Bright from about zero to well over 175 amps./sq. ft. |
| Bath of Example VI | Bright from about zero to well over 175 amps./sq. ft. |
| Bath of Example IV, but without the linear aliphatic amine polymer | Semi-bright to bright from about zero to 45 amps./sq. ft. Dark and spongy deposits above 45 amps./sq. ft. with no brightness. |
| Bath of Example IV, but without the ethylene oxide condensate | Very dark, irregular plate from about zero to 80 amps./sq. ft., with many random areas of no plate. |
| Bath of Example IV, but without Benzylidene acetone | Very dull from about zero to 40 amps./sq. ft., from dull to semi-bright between 40 and 100 amps./sq. ft., and course and dull above 100 amps./sq. ft. |
| Bath of Example IV, but using unreacted diethylene triamine in place of the linear aliphatic amine polymer derived from diethylene triamine and epichlorohydrin | Bright from about zero to about 80 amps./sq. ft. Dark and course deposits over 80 amps./sq. ft. |
| Bath of Example IV, but using unreacted tetraethylene pentamine in place of the linear aliphatic amine polymer | Bright from about zero to about 120 amps./sq. ft. Dark and course deposits over 120 amps./sq. ft. |

*All baths at 85° F.

TABLE IV

| BATH COMPOSITION | PLATING TEST RESULTS AFTER ELECTROLYSIS OF 1 AMP.-HOUR/267 ml. |
|---|---|
| Bath of Example IV | Extremely bright from about zero to well over 175 amps./sq. ft. |
| Bath of Example IV, but with Polyethylene imine (M.W.=600) used in place of the linear aliphatic amine polymer | Dark cloud at about zero to 5 amps./sq. ft. Bright from 5 amps./sq. ft. to over 175 amps./sq. ft. |
| Bath of Example IV, but with aminated polyepichlorohydrin, wherein the amine is dimethylamine, in place of the linear aliphatic amine polymer | Dark cloud at about zero to 6 amps./sq. ft. Bright from 6 amps./sq. ft. to over 175 amps./sq. ft. |
| Bath of Example IV, but diethylene triamine in place of the linear aliphatic amine polymer | Very dark deposits at about zero to 10 amps./sq. ft. Bright from about 10 to 80 amps./sq. ft. Dark and course deposits above 80 amps./sq. ft. |
| Bath of Example IV, but tetraethylene pentamine in place of the linear aliphatic amine polymer | Very dark deposits from about zero to 7 amps./sq. ft. Bright from 7 to about 120 amps./sq. ft. Dark and course above 120 amps./sq. ft. |

**All baths at 85° F

TABLE V

| BATH COMPOSITION | PLATING TEST RESULTS |
|---|---|
| Bath of Example IV, but at a temperature of 100° F | Extremely bright from about zero to well over 175 amps./sq. ft. |
| Bath of Example IV, but at a temperature of 100° F and Polyethylene imine (M.W.=600) in place of the linear aliphatic amine polymer. | Bright from about zero to about 30 amps./sq. ft. Cloudy from 30 amps./sq. ft. to over 175 amps./sq. ft. |

Having thus described the invention in such full, clear, concise, and exact terms as to enable any person skilled in the art to which it pertains to make and use the same and having set forth the best mode contemplated of carrying out this invention in accordance with the patent statutes, it will be apparent to those skilled in the art that equivalents or modifications of the above specifically described embodiment of the invention may be made without departing from the spirit of the invention disclosed and described, the scope of the invention being limited solely by the scope of the attached claims.

I claim:

1. A zinc brightener additive comprising:

from about 99 percent to about 1 percent by weight by a linear aliphatic amine polymer prepared by reacting at a temperature of from about 110° F to about 220° F from about 50 percent to about 150 percent of a stoichiometric amount of an epihalohydrin selected from the group consisting of epichlorohydrin and epibromohydrin and a linear aliphatic polyamine selected from the group consisting of a compound having at least two primary amine groups, two secondary amine groups, or one primary and one secondary amine group, said amine groups separated by two through six methylene groups or alkyl substituted methylene groups, and including from about 1 to about 99 percent by weight of an ethylene oxide condensation product, said product resulting from condensing about 6 to about 30 moles of ethylene oxide with 1 mole of a compound selected from the group consisting of a long chain fatty alcohol, a long chain fatty amine, a long chain fatty acid, a long chain alkyl phenol, wherein said long chains contain from 6 to about 30 carbon atoms, and naphthol.

2. A zinc brightener additive according to claim 1, including from about 1 to about 20 percent by weight of an aromatic aldehyde or aromatic ketone.

3. A zinc brightener additive according to claim 2, wherein the aromatic ketone is benzylidene acetone.

4. A zinc brightener additive according to claim 3, wherein said stoichiometric amount ranges from about 0.75 to about 1.25.

5. A zinc brightener additive according to claim 2, wherein said ethylene oxide condensation product is a product resulting from a condensation of ethylene oxide and beta naphthol.

6. A zinc brightener additive according to claim 5, wherein there is also present about 1 to 20 percent by weight of benzylidene acetone.

7. A zinc brightener additive according to claim 6, wherein said stoichiometric amount ranges from about 0.75 to about 1.25.

8. A zinc brightener additive according to claim 1, wherein said linear aliphatic polyamine compound is selected from the group consisting of ethylene diamine, propylene diamine, diethylene triamine, triethylene tetramine, tetraethylene pentamine, pentaethylene hexamine, and N-(2-aminoethyl)-1,3-propanediamine.

9. A zinc brightener additive according to claim 8, including from about 1 to about 20 percent by weight of an aromatic aldehyde or aromatic ketone.

10. A zinc brightener additive according to claim 9, wherein the aromatic ketone is benzylidene acetone.

11. A zinc brightener additive according to claim 10, wherein said stoichiometric amount ranges from 0.75 to about 1.25.

12. A zinc brightener additive according to claim 8, wherein said ethylene oxide condensation product is a product resulting from a condensation of ethylene oxide and beta naphthol.

13. A zinc brightener according to claim 12, wherein there is also present from about 1 to 20 percent by weight of benzylidene acetone.

14. A zinc brightener additive according to claim 13, wherein said stoichiometric amount ranges from about 0.75 to about 1.25.

15. An aqueous, acid zinc electroplating bath for producing a bright electrodeposit of zinc, containing zinc ions, comprising:

having dissolved therein from about 0.5 to 10 grams/liter of an aliphatic amine polymer prepared by reacting from about 50 percent to about 150 percent of a stoichiometric amount of an epihalohydrin selected from the group consisting of epichlorohydrin and epibromohydrin with a linear aliphatic polyamine selected from the group consisting of a compound having at least two primary amine groups, two secondary amine groups, or one primary and one secondary amine group, said amine groups separated by two through six methylene groups or alkyl substituted methylene groups, including from about 1 to about 10 grams/liter of an ethylene oxide condensate product, said ethylene oxide condensation product is formed by condensing at least 6 to about 30 moles of ethylene oxide with 1 mole of a compound selected from the group consisting of a long chain fatty alcohol, a long chain fatty amine, a long chain fatty acid, a long chain alkyl phenol, wherein said long chains have from 6 to about 30 carbon atoms, and naphthol.

16. The bath according to claim 15, wherein there is also present from about 0.05 to about 0.5 grams/liter of at least one compound selected from the group consisting of aromatic aldehydes and aromatic ketones.

17. The bath according to claim 16, wherein said aromatic aldehydes and aromatic ketones are selected from the group consisting of benzylidene acetone, vanillan, heliotropin, anisaldehyde, veratraldehyde, acetophenone, acetonaphthone, cinnamic aldehyde, 2-chlorobenzaldehyde, and 2,6-dichlorobenzaldehyde.

18. The bath according to claim 17, wherein there is also present from about 100 to about 300 grams/liter of ammonium chloride.

19. The bath according to claim 16, wherein the aromatic ketone is benzylidene acetone.

20. The bath according to claim 19, wherein the ethylene oxide condenstion product is a product resulting from the condensation of ethylene oxide and beta naphthol.

21. The bath according to claim 20, wherein said stoichiometric amount ranges from about 0.75 to about 1.25.

22. The bath according to claim 21, wherein there is also present from about 100 to about 300 grams/liter of ammonium chloride.

23. The bath of claim 22, wherein the range of zinc ions is from about 7.5 to about 40 grams/liter.

24. The bath according to claim 19, wherein there is also present from about 100 to 300 grams/liter of ammonium chloride.

25. The bath according to claim 19, wherein said stoichiometric amount ranges from 0.75 to 1.25.

26. The bath according to claim 16, wherein there is also present from about 100 to about 300 grams/liter of ammonium chloride.

27. A bath according to claim 15, wherein the pH is from about 4.0 to about 6.5.

28. The bath of according to claim 15, wherein said linear aliphatic polyamine compound is selected from the group consisting of ethylene diamine, propylene diamine, diethylene triamine, triethylene tetramine, tetraethylene pentamine, pentaethylene hexamine, and N-(2-aminoethyl)1,3-propanediamine.

29. The bath according to claim 28, wherein there is also present from about 0.05 to about 0.5 grams/liter of at least one compound selected from the group consisting of aromatic aldehydes and aromatic ketones.

30. The bath according to claim 29, wherein the pH is from about 4.0 to 6.5

31. The bath according to claim 29, wherein said aromatic aldehydes and aromatic ketones are selected from the group consisting of benzylidene acetone, vanillan, heliotropin, anisaldehyde, veratraldehyde, acetophenone, acetonaphthone, cinnamic aldehyde, 2-chlorobenzaldehyde, and 2,6-dichlorobenzaldehyde.

32. The bath according to claim 31, wherein the aromatic ketone is benzylidene acetone.

33. The bath according to claim 32, wherein the ethylene oxide condensation product is a product resulting from the condensation of ethyelene oxide and beta naphthol.

34. The bath according to claim 33, wherein said stoichiometric amount ranges from about 0.75 to about 1.25.

35. The bath according to claim 34, wherein there is also present from about 100 to about 300 grams/liter of ammonium chloride.

36. The bath of claim 35, wherein the range of zinc ions is from about 7.5 to about 40 grams/liter.

37. The bath according to claim 32, wherein there is also present from about 100 to about 300 grams/liter of ammonium chloride.

38. The bath according to claim 32, wherein said stoichiometric amount ranges from 0.75 to about 1.25.

39. The bath according to claim 31, wherein there is also present from about 100 to about 300 grams/liter of ammonium chloride.

40. The bath according to claim 29, wherein there is also present from about 100 to about 300 grams/liter of ammonium chloride.

41. The bath according to claim 28, wherein there is also present from about 100 to about 300 grams/liter of ammonium chloride.

42. The bath of claim 15 wherein said zinc ions are obtained from a zinc chloride salt.

43. The bath of claim 15, wherein there is also present from about 100 to about 300 grams/liter of ammonium chloride.

* * * * *